United States Patent [19]

Haas

[11] Patent Number: 4,665,550

[45] Date of Patent: May 12, 1987

[54] ELECTRODYNAMIC LOUDSPEAKER HAVING OMNIDIRECTIONAL SOUND EMISSION

[76] Inventor: Rainer J. Haas, Käthe-Kollwitz-Strasse 1, 5000 Cologne 50, Fed. Rep. of Germany

[21] Appl. No.: 702,090

[22] Filed: Feb. 15, 1985

[30] Foreign Application Priority Data

Feb. 17, 1984 [DE] Fed. Rep. of Germany ..... 3405635

[51] Int. Cl.[4] ..... H04R 9/06; H04R 1/02

[52] U.S. Cl. ..... 381/182; 181/144; 381/88; 381/186; 381/188; 381/192; 381/199

[58] Field of Search ..... 179/115.5 PC, 115.5 R, 179/115.5 ES, 146 E, 146 R, 179, 117, 119; 381/88, 89, 90; 181/144, 163

[56] References Cited

U.S. PATENT DOCUMENTS

| | | | |
|---|---|---|---|
| 3,393,764 | 7/1968 | Schafer | 179/146 E |
| 3,456,755 | 7/1969 | Walker | 179/115.5 R |
| 3,686,446 | 8/1972 | Manger | 179/115.5 R |
| 3,720,787 | 3/1973 | Ishii et al. | 381/90 |
| 4,472,605 | 9/1974 | Klein | 179/115.5 PS |

FOREIGN PATENT DOCUMENTS

| | | | |
|---|---|---|---|
| 1350051 | 4/1974 | United Kingdom | 381/88 |

*Primary Examiner*—Gene Z. Rubinson
*Assistant Examiner*—Danita R. Byrd
*Attorney, Agent, or Firm*—Steele, Gould & Fried

[57] ABSTRACT

An electrodynamic loudspeaker for the high or mid-range sound region emits sound omnidirectionally. The loudspeaker comprises two identical individual loudspeakers arranged on opposite sides of a plane of mirror symmetry. Each loudspeaker has a drive unit with a permanent magnet fixed at a carrier part common to both sides and a moving coil means, including a winding and a bobbin, elastically held by a spider at carrier part. Each moving coil means is rigidly connected with a hemispherical membrane. The carrier part is formed as a ring and is limited by a spherical ring surface having a diameter which is somewhat smaller than twice the diameter of the outer rim of the membrane. The moving coil means has a diameter substantially the same as the outer edge of the membrane.

14 Claims, 5 Drawing Figures

ELECTRODYNAMIC LOUDSPEAKER HAVING OMNIDIRECTIONAL SOUND EMISSION

BACKGROUND OF THE INVENTION

1. Field of the Invention

The invention relates to an electrodynamic loudspeaker, especially a tweeter or mid-range loudspeaker, having omnidirectional emission of sound, said loudspeaker being made of two identical individual loudspeakers arranged on both sides of a plane of symmetry and having coaxial, oppositely directed drive units incorporating in each case

- a permanent magnet fixed at a common carrier part, and
- a moving coil means (sometimes referred to as a voice coil wound on a bobbin) resiliently and yieldably held by a spider at said carrier part and rigidly fixed to a dome-like membrane in each case.

2. Prior Art

In the electrodynamic loudspeaker known from the French patent No. 1 146 757 a drive unit of each individual loudspeaker is arranged within hemispherical membranes, the moving coil means having one fifth of the diameter of the outer rim of the membranes. They are thus fixed only in their summit region at the respective membrane. This gives rise to irregular conditions of oscillation, the membranes deform themselves and at all events do not move as a rigid entity as intended. The influence of an additional spider has to be taken into account, too, as this spider connects the membrane along a circle of approximately half the diameter of the outer rim to the permanent magnet of the drive unit. To summarize, during movement of the membrane by the attached moving coil, the outer rim sections of the membrane are left behind and partial vibrations are formed across the membrane. They are the origin of secondary emissions of sound, which do not coincide with the original sound to be reproduced.

In addition, the known electrodynamic loudspeaker does not allow for an optimal omnidirectional emission of sound, because its carrier part is continued outwards in the form of a ring. The drive units are connected to each other in such a way, that the two membranes always perform movements in the same direction. The individual loudspeakers cannot reproduce different sound signals.

U.S. Pat. No. 3,456,755 shows an hydraulic loudspeaker which is also assembled from two semispherical individual loudspeakers having electrodynamic drive units. In this device, the moving coil means is not rigidly connected to the membrane. Further, the diameter of the moving coil means amounts to only one eighth of the diameter of the outer rim of the membrane.

U.S. Pat. No. 3,393,767 shows a loudspeaker of spherical shape as seen from the exterior. Two loudspeakers having cone shaped membranes are mirror-symmetrically arranged. An omnidirectional emission of sound cannot be obtained, as the sound emission of each individual loudspeaker, having a cone shaped membrane, is effected in a preferred direction.

Finally U.S. Pat. No. 4,472,605 shows an electrodynamic loudspeaker constructed in a similar way as the loudspeaker mentioned above. This device is exclusively intended for low sound frequencies. In this loudspeaker the relation of the diameter of the moving coil means and the diameter of the outer rim of the semispherical membrane is one and nine. In order to avoid that the proportion of the membrane is too-locally confined, semispherical transmission parts are arranged between the moving coil and the membrane, so that the membrane indeed is rigidly connected to the moving coil means, but this connection is not achieved directly but by means of a transmission part arranged inbetween.

These known spherical loudspeakers do not give satisfactory results in their emission of sound. Secondary vibrations of the dome-shaped membranes exist and are not sufficiently suppressed, and the propulsion is too weak compared to the surface of the membrane. To sum up the results obtained in sound emission are unsatisfactory.

In the tweeter and mid-range loudspeakers of the electrodynamic type predominantly used at present the diameter of the moving coil means generally equals the diameter of the outer rim of the membrane. This provides for an efficient propulsion, secondary resonances of the membrane are extensively reduced, and the membrane oscillates even at high sound frequencies mainly as a rigid body. These loudspeakers having dome-shaped membranes on the other hand do not provide for an omnidirectional emission of sound.

It is here that the invention provides a remedy. It is the object of the invention to avoid the draw-backs of the known electrodynamic loudspeakers having omnidirectional emission of sound and to provide, on the basis of the construction principles of the known dome loudspeakers, for an efficient precisely reproducing electrodynamic loudspeaker of the kind indicated above having an omnidirectional emission of sound, wherein said loudspeaker is of a simple construction and may be easily fixed to a supporting part.

SUMMARY OF THE INVENTION

Starting from the known electrodynamic loudspeaker, this object is achieved in that the diameters of the moving coil means are not essentially smaller than the diameter of the outer rim of the membranes, that the carrier part is of ring-like shape, defining a part of a sphere having a diameter which is preferably somewhat smaller than twice the diameter of the outer rim of the membranes, and that said carrier part has at least one (in the case of the tweeter), at the most two (in the case of a mid-range loudspeaker) oppositely directed protuding mounting posts, that may be connected to a supporting unit.

This electrodynamic loudspeaker is assembled of two individual dome-loudspeakers arranged back to back and held together by a ring-shaped carrier part. The shape of this ring-like carrier part is an important feature and the shape chosen avoids a reduction of sound pressure emitted obliquely to the direction of movement of the two membranes, so that an almost perfect omnidirectional emission of sound is obtained.

The diameter of the moving coil means (or voice coil means) is defined to be not essentially smaller than the diameter of the outer rim of the membrane, with differences of up to twenty percent contemplated. In any case, the diameter of the moving coil means should not be smaller than the half of the diameter of the outer rim of the membrane. Almost equal diameters of the moving coil means and the outer rim of the membrane are preferred. In contrast to the attempts known up to now to build omnidirectionally emitting loudspeakers, the areas of the membrane of the inventive loudspeakers are relatively small compared to the total surface area of the loudspeaker, i.e. compared to the sum of the membrane areas, and the exposed surface area of the carrier part. Up to now, omnidirectionally emitting loudspeakers were constructed in such a way that their outer surface is almost exclusively, and in any case predominantly defined by semispherical membranes. It is surprising that this way of construction, accepted up to now as the leading construction, does not lead to optimal results. Much better results may be obtained by the inventive loudspeaker, though it has active sound emitting surfaces that are relatively small compared to the total surface area of the loudspeaker.

The carrier part should be constructed as small as possible. It is the object of this carrier part to lodge and fix permanent magnets for the two drive units as close to one another as possible. Further, the spider is attached to the carrier part and elastically and yieldably connects the carrier part to the outer rim of the membrane. Only one or two oppositely arranged protrusions or adapters, protrude from said carrier part. The loudspeaker is mounted using adapters. In this way the omnidirectional emission of sound is influenced as little as possible. In the case of a tweeter, the loudspeaker has only one adapter for mounting on a supporting part or atop of a mid-range loudspeaker. The mid-range loudspeaker has two opposite adapters, an upper one for receiving the tweeter and a lower for mounting to a supporting part. This does not exclude a pendant arrangement of the loudspeaker.

Preferably, the carrier part is assembled from two identical body halves united in a plane of mirror symmetry. Each half has a lodging bore for a permanent magnet limited outwardly by an inwardly protruding shoulder keeping the magnet within the bore. Assembly of the inventive loudspeaker is very easy as, by putting together the two halves of the carrier part, which is effected especially by means of screws, the two permanent magnets are likewise fixed. An elastic element is arranged between the opposing back faces of the magnets in order to push the magnets against the shoulder.

In a preferred embodiment the mounting posts or adapters are hollow, to allow for electrical leads of the individual loudspeakers to be run through. The leads are thereby mechanically protected. On the other hand, a plug connection may be arranged in the mounting post, so that the mounting post or adapter not only serves for mechanical mounting, but for electrical attachment, too. A bayonet socket has proven very successful, as such a connection determines the position of the individual loudspeakers.

A carrier part is, at its region closest to the spider, limited by a flat circular ring lying in the plane of the spider and being as small as possible. This ring is contiguous with a carefully rounded section adjoining a spherical ring which is symmetrically arranged to a plane of mirror symmetry. The reduction of sound pressure in oblique directions is thereby lessened.

In a preferred embodiment the carrier part has a covering ring defining at least a part of the outer surface of the carrier part and providing for a cover of the affixation bores. This cover ring especially provides for a masking of the membrane if ducts for admission of air are provided as known from German utility model 81 04 570. Such ducts prevent secondary emissions from the spider.

In a preferred embodiment the leads of each moving coil are separately run outwards. It is therefore possible to apply different sound signals to the two individual loudspeakers of the electrodynamic loudspeaker. More particularly, the two individual loudspeakers may be driven by one and the same electrical signal in counter phase, so that the two membranes either approach each other or move apart from each other and an omnidirectional emission is obtained.

In a preferred embodiment of the invention a lower mid-range loudspeaker of the invention, and on top of it a tweeter having a smaller diameter is arranged, the two loudspeakers being oriented in such a way that their membranes move in parallel directions.

Further advantages and characteristics of the invention will be apparent from the further claims and the following description of a non-limiting embodiment of a tweeter and a mid-range loudspeaker, which are elucidated in the following.

BRIEF DESCRIPTION OF THE DRAWINGS

There are shown in the drawings the embodiments which are presently preferred. It should be understood, however, that the invention is not limited to the precise embodiments shown in the drawings, wherein.

DETAILED DESCRIPTION OF THE PREFERRED EMBODIMENTS

Figure 1:
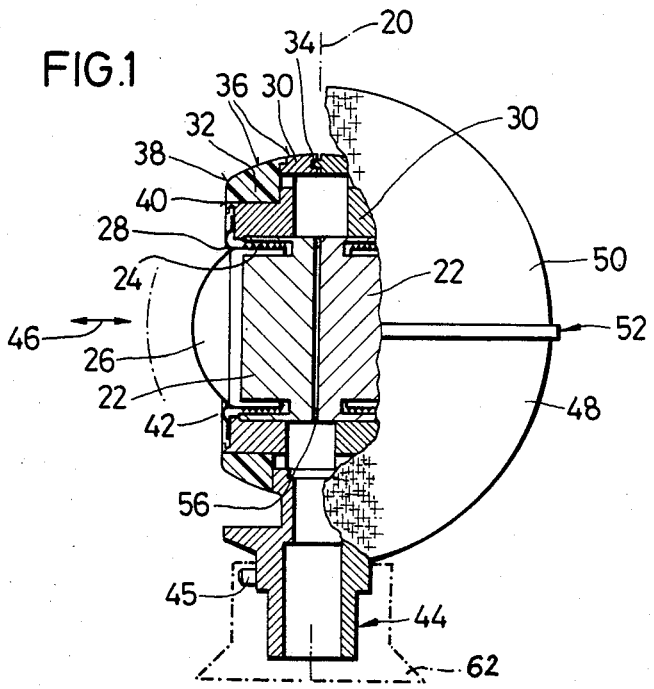
FIG. 1 shows a side elevation of a tweeter mainly in form of a sectional view.

In FIG. 1 the construction of a tweeter is shown. This loudspeaker is assembled of two identical individual loudspeakers arranged on both sides of a plane 20 of mirror symmetry and having in each case an electrodynamic drive unit. The two drive units are coaxial and oriented in opposite directions. Each comprises a permanent magnet 22 having an annular gap. Magnets of highest magnetic field strength and smallest dimensions are used. A moving coil means 24, including a rigid bobbin attached to the membrane, in each case plunges into an annular gap and the bobbin carries in known fashion a winding having electrical leads to which an electrical signal is supplied during use. At its foremost region the movable coil means 24 is directly and rigidly attached to the dome-like (semispherical) membrane 26 with an outer rim having a diameter identical to the diameter of the moving coil means 24. A semispherical piece of felt (not shown) may be arranged on the inside of the membrane 26. The outer rim of the membrane 26 is elastically and yieldably attached to a carrier part by a spider 28. The carrier part is assembled of two pieces, in each case constructed of an inner body part 30 and a covering ring 32. Identical covering rings 32 and mainly identical, but having different fitting protrusions 34 or bores, inner body parts 30 are arranged on both sides of the plane 20 of mirror symmetry.

As can be seen from FIG. 1 the carrier part assembled in each case of two inner body parts 30 and two covering rings 32 is limited by a spherical ring surface 36 having a diameter which in the embodiment shown equals twice the diameter of the membrane 26. The distance between the point of the arrow on lead line 38 and its mirror symmetrical equivalent on the other side of plane 20 is equal to the distance between the two spiders 28. The spherical ring surface 36 is contiguous towards the spider 28 with a rounded portion 38 which in turn is contiguous with a flat ring surface 40. In the region of this flat ring surface 40 the covering ring 32 outwardly overlaps the spider 28 to impede sound emission from the spider 28. The space between spider 28 and covering ring 32 is connected to the outside by air admission ducts 42.

Good omnidirectional emission of sound is still obtained if the diameter of the spherical ring surface 36 is three times the diameter of the outer rim of the membrane 26, but a higher ratio should not be chosen.

At the inner body part 30, in each case, a half shell protrudes forming with the one of the other inner body part 30 a hollow mounting post 44 or adapter. This mounting post or 44 is on a plane 20 of mirror symmetry and is disposed orthogonally to the direction of movement defined by arrow 46 of both membranes 26. It is equipped with a bayonet socket 45 and with an electrical plug connection (not shown). The loudspeaker is protected against physical damage by two semispherical metallic grids 48, 50. The grids 48, 50 are releasably connected in an equatorial plane (arrow 46 lies on the equitorial plane) and is oriented orthogonally to the plane 20 of mirror symmetry. The lower metallic grid 48 is attached to the adapter 44 and holds the upper grid 50.

The two inner body parts 30 of a loudspeaker are mutually held together by appropriate tensioning devices, for instance screws. The inwardly protruding shoulders 54 of the two inner body parts 30 press, under the action of these tensioning devices, the two permanent magnets 22 against each other whereby an elastic piece is arranged between the two permanent magnets 22, for instance a ring 56 of soft foam rubber pressing the magnets 22 against the fixation rim 54. In a preferred embodiment the inner body parts 30 and the covering rings 32 are made of plastic though other materials are not excluded.

Figure 2:
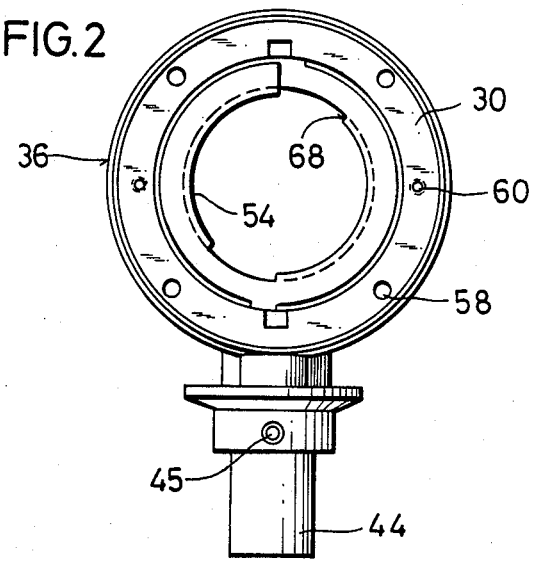
FIG. 2 shows a side elevation of a carrier part of a loudspeaker according to FIG. 1, a covering ring being removed.

FIG. 2 shows an inner body part 30. The shoulder 54 is not continuous but has gaps in order that a precise positioning of the magnets 22 may be controlled and watched. Four equiangularly spaced bores 58 are provided for pulling the two inner body parts 30 of a loudspeaker against each other by means of screws. Affixation of the covering ring 32 at the inner body part 30 is effected by screws which are screwed into two bores having inner threads 60.

The mid-range loudspeaker principally is constructed just as the tweeter described above. However, its carrier part exhibits a second protruding mounting post 62 or adapter arranged in the plane 20 of mirror symmetry, too, and lying diametrically opposed and coaxial to a first protruding mounting post 61 or adapter. This second adapter 62 serves for the reception of adapter 44 of the tweeter and at the same time houses the electrical connection means. As FIG. 3 shows, the two bayonet protrusions 45 protrude in the same direction in order to assure that the directions of sound emission of a tweeter and an attached mid-range loudspeaker is parallel to the direction of movement 46.

Figure 3:
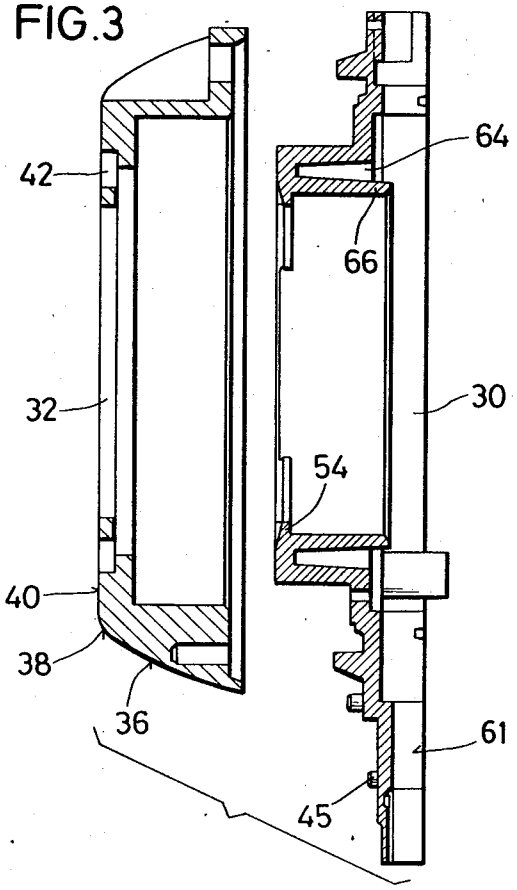
FIG. 3 shows an exploded view of a half of a carrier part having a covering ring and an inner body part for a mid-range loudspeaker, the parts shown in sectional view.

The inner body part 30 according to FIG. 3 has an annular shaped groove 64 so that a collar 66 is formed which resiliently engages the permanent magnet and is fitted along the outer circumference of the permanent magnet.

Figure 4:
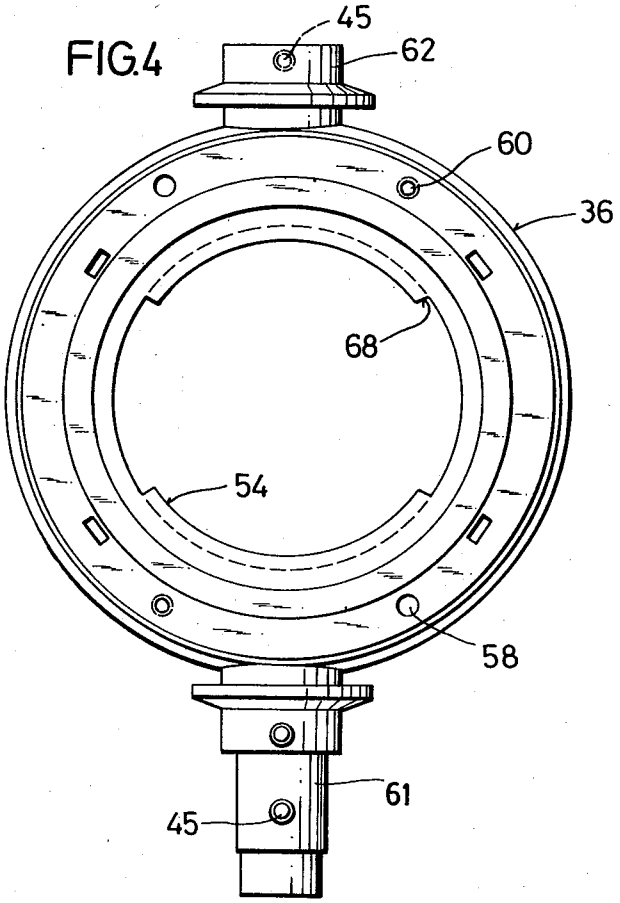
FIG. 4 shows a front view of an inner body part of the mid-range loudspeaker of FIG. 3; and, FIG. 5 is a partially broken away view of an alternative embodiment.

FIG. 4 shows the two mounting posts or adapters 61, 62 of an inner body part 30 of a mid-range loudspeaker. Affixation of the two inner body parts 30 is different from the manner of attachment shown in FIG. 2. The inner body parts 30 of the mid-range loudspeaker are constructed in such a way that space for the passage of a total of four leads of the tweeter remains. This space may be provided by the groove 64. On the other hand the two mounting posts or adapters 61, 62 can be connected by a tube-like piece which stiffens the device and provides a channel for the leads of the tweeter. The two moving coils 24 of the mid-range loudspeaker may be separately fed by different electric signals.

Figure 5:
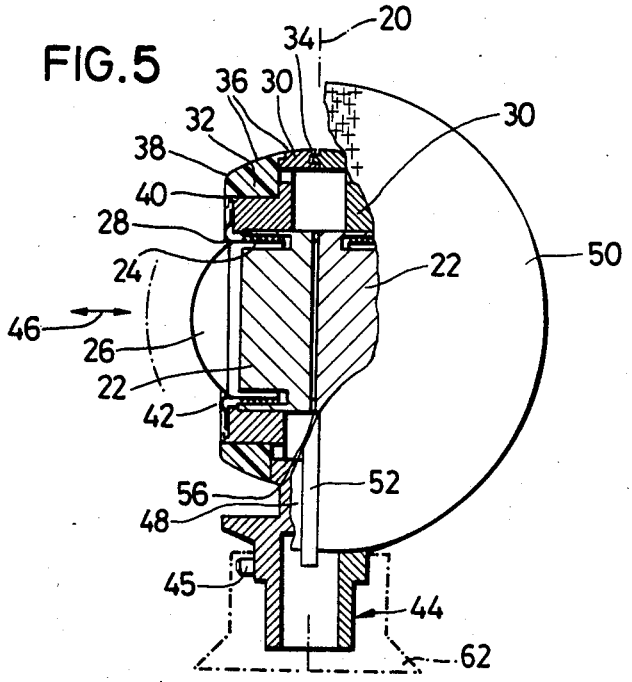

In an alternative embodiment shown in FIG. 5, the two semispherical metallic grids 48, 50 are fixed to each other in the plane of mirror symmetry 20. They are held by a supporting ring which is rigidly connected with the inner body part 30. This ring has a larger diameter than the spherical ring surface 36 and is held by a small number of narrow spacers at the proper inner body part 30. The ring has a wedge shaped groove which receives the protective grids 48, 50. FIG. 5 also shows how protrusion or adapter 44 fits into a support 62.

The circular lodging recesses formed by the inner walls of collars 66 are open towards the center of the loudspeaker (see FIG. 1). There is no separation wall between the backs of the two drive units, resp. backs of the two magnets 22.

As can be seen from FIGS. 1 and 3, the spherical ring surface 36 is formed by an exposed section of an inner body part and a section of a covering ring and extends to both sides of the plane 20 of mirror-symmetry almost up to a plane defined by the flat ring surface 40. The rounded portion 38 is rather small (about 10% of the distance between the plane 20 and the said plane defined by the surface 40) and provides for a smooth changeover between the spherical ring surface 36 and the flat ring surface 40.

FIG. 1 shows, how the upper adapter 62 of a mid-range loudspeaker (see FIGS. 3 and 4) serves as supporting unit for hanging or standing support. A socket portion like adapter 62 for receiving the adapter 44 may be employed.

What is claimed is:

1. An electrodynamic loudspeaker system, having omnidirectional emission of sound, comprising:

two identical loudspeakers arranged about a plane of symmetry, each of the loudspeakers having a carrier part having an inner body part and a covering ring, the covering ring having a spherical ring portion, a rounded portion adjoining the spherical ring portion and a flat ring surface adjacent the rounded portion, each of the loudspeakers having coaxial, oppositely directed drive units mounted back to back, each drive unit having a permanent magnet fixed at the carrier part and a movable coil means with a bobbin carrying windings, the bobbin being resiliently and yieldably held by a spider at said carrier part and rigidly fixed to a dome-like membrane, the movable coil means having a diameter not less than approximately one-half of the diameter of an outer rim of the membrane; and, each of the carrier parts having its flat ring surface located substantially in a plane defined by the spider, and each carrier part having at least one mounting post, but not more than two oppositely directed mounting posts and being adapted for attaching the loudspeaker system to a support.

2. The loudspeaker system of claim 1, wherein the inner body parts contact each other on the plane of symmetry, each inner body part having a lodging recess for a permanent magnet, the lodging recess being defined by a collar means and a fixation rim.

3. The loudspeaker system of claim 2, wherein the inner body parts contact each other on the plane of symmetry at a fitting means having complementary bores and fitting protrusions, and wherein said at least one mounting post of each carrier part is semicircular and wherein said semicircular mounting posts of the two carrier parts are arranged together to form a tubular mounting post.

4. The loudspeaker of claim 3, wherein the covering ring at least partially overlaps the spider and the covering ring has ducts for admission of air.

5. The loudspeaker system of claim 1, wherein the at least one mounting post is hollow for passage of leads for said movable coils.

6. The loudspeaker system of claim 5, wherein the mounting posts are equipped with electrical connectors.

7. The loudspeaker system of claim 6, wherein said electrical connectors have bayonet locking means.

8. The loudspeaker system of claim 1, further comprising leads for each movable coil, the leads being separately arranged, whereby the leads may be separately connected to different signal sources.

9. The loudspeaker system according to claim 1, further comprising hemi-spherical outer protecting grids of wire, at least one of the grids being held by said at least one protrusion.

10. The loudspeaker system of claim 1, further comprising a supporting ring for two hemi-spherical protecting grids, said supporting ring being arranged in the plane of symmetry.

11. The loudspeaker system of claim 1, wherein the loudspeaker is a midtone loudspeaker for mid-range frequencies.

12. The loudspeaker system of claim 1, wherein said carrier part has two mounting posts directed in opposite directions, for connection to the support.

13. The loudspeaker system of claim 1, wherein the spherical ring portion has a diameter less than twice that of an outer rim of the membrane.

14. The loudspeaker system of claim 1, wherein the loudspeaker is a tweeter for upper-range frequencies.

* * * * *